United States Patent [19]

Carmean

[11] Patent Number: 4,568,810

[45] Date of Patent: Feb. 4, 1986

[54] OVEN COOKING CONTROL SYSTEM WITH SCANNING DISPLAY

[75] Inventor: Silas E. Carmean, Mansfield, Ohio

[73] Assignee: The Tappan Company, Mansfield, Ohio

[21] Appl. No.: 571,433

[22] Filed: Jan. 17, 1984

[51] Int. Cl.[4] ..... H05B 6/64

[52] U.S. Cl. ..... 219/10.55 B; 219/10.49 R; 340/365 C

[58] Field of Search ..... 219/10.55 B, 10.55 R, 219/10.55 E, 489, 506, 10.49 R; 364/900; 340/365 R, 365 C, 365 VL, 337; 99/324, 325, 326

[56] References Cited

U.S. PATENT DOCUMENTS 4,317,977 3/1982 Buck ..... 219/10.55 B 4,447,692 5/1984 Mierzwinski ..... 219/10.55 B 4,459,449 7/1984 Hirata ..... 219/10.55 B

*Primary Examiner*—C. L. Albritton

*Assistant Examiner*—M. N. Lateef

*Attorney, Agent, or Firm*—Alfred E. Miller

[57] ABSTRACT

A microwave oven with a microprocessor control which contains stored recipe information. The user enters food type, quantity to be cooked, and size or doneness desired. Data for cooking a large number of different foods may be stored. The specific food item to be cooked is user selected by touching and holding one of ten food category pads. Food items within the category selected then "scroll" through an alphanumeric display. The item shown in the display when the food pad is released is the one selected for cooking. Following food selection, the user is prompted, via the alphanumeric display, to enter such additional data as quantity, size and doneness desired.

8 Claims, 3 Drawing Figures

OVEN COOKING CONTROL SYSTEM WITH SCANNING DISPLAY

This invention relates to a microwave oven control system and control panel arrangement for use in a microwave oven.

As the art of microwave oven control systems advances, the control of the systems has become more complicated. As a result, many potential users of microwave ovens have either been afraid to attempt the use of the ovens, or have limited their use to inefficient manual control. In order to effectively use an advanced microwave oven, it is necessary to program the control system in accordance with the particular food being cooked or heated.

Some of the first microwave oven control systems that were developed merely provided the operator with controls for setting the power level of the cooking and the time of cooking. For cooking any type of food, then, it was necessary to consult a separate list or book, or the like, in order to determine the time and power levels of one or more sequences to be set into the control system.

The vast majority of foods cooked in a microwave oven by most domestic users falls within a relatively small number of foods, for example about 50 or 60 foods. In view of this, more recent development in microwave oven control systems have attempted to simplify the cooking of foods within this limited group by enabling the entry into a numerial key pad or dial on the oven control panel of codes corresponding to the food to be cooked, the codes pertaining to the given food being more conveniently presented, for example, in a listing on the front of the device, or in a listing in a book. In such systems, once the entry had been made of the code corresponding to the foods, a display of the control system prompted the user to enter various other information, such as, for example, the size or volume of the food to be cooked, and, with respect to some foods, the desired "Doneness".

While the oven control system may include a dial or pushbuttons enabling the selection of specific foods for cooking, as disclosed, for example, in U.S. Pat. No. 4,324,966, Tanabe, only a limited number of foods may be selected in this manner, since it is not feasible to provide separate controls or dial positions for more than a few foods. Although perhaps the selector or pushbuttons may be of minimal size, the indicia required in order to enable a user to identify the proper switch positions, pads required an invertent amount of panel space.

A further microwave oven control system is disclosed in U.S. Pat. No. 4,158,759, Mason, wherein a separate key pad is provided for each digit of the numeric display, in order to eliminate the need for ten numeric key pads. Operation of any of the key pads slews the levers of the corresponding display digit. This system, while minimizing numeric entry key pads, does not solve the problem of simplifying the programming of the microwave oven for cooking of common foods.

Control systems of the past have therefore always required reference to external information, either in a book or listing on the device, for indicating to the user certain data to be entered into the key pad.

The present invention is directed to a control system that greatly simplifies the process of cooking foods in a microwave oven, and that, for most foods, does not require reference to tables or books for data to be entered into the key pads.

Briefly stated, in accordance with the invention, a microwave oven is provided with a control system having key pads for entering data, and a display. The display includes an alphanumeric display of, for example, ten or more characters, along with a preferably separate display for displaying time functions and other data.

In addition to the normal key pads enabling numerical entry and functions such as "Defrost", "Probe", "Timing", and "Clock Functions", as desired the control further includes key pads separately identifying generic food groups, such as, for example, beverages, seafood, meat, canned soup, frozen vegetables (either package or pouch), poultry, fresh vegetables, and canned vegetables. A further key pad is provided for controlling the "Doneness" or "Size", as will be discussed in the further paragraphs.

When it is desired to cook a specific type of food within the programmed capability of the microwave oven, after turning the device on, the user presses one of the key pads identifying a specific generic group of foods. For example, assume that it is desired to cook three large baked potatoes. In this case, the user would press the key pad identified as "Fresh Vegetables". The program of the cooking system responds to the depression of this key pad by scanning, and sequentially displaying on the alphanumeric display, the names of the "Fresh Vegetables" for which the control system is programmed, as long as the respective key pad is touched. The display of each food item during the scanning sequence may be, for example, about one to two seconds. The program preferably displays such food items in the order of their expected frequency of use, to minimize the time required for programming the oven. Upon the display of the selected vegetable, in this case, potatoes, the user removes his or her finger from the key pad.

The program of the system then energizes the alphanumeric display to provide prompts of a further characteristic of the food, such as, for example, the quantity of food. In the above example, the prompt may be "How many?", prompting the user to enter the number of potatoes to be cooked in the numeric key pads. Upon entering the number "3", in the above example, the program of the system provides a further prompt, to request the user to depress the "Doneness/Size" key pad, for the entry of further data. Upon the depression of this latter key pad, the program energizes the alphanumeric display to sequentially scan and display the various "Doneness" or "Size" possibilities of the selected food. For example, when potatoes have been selected, the prompts "Small", "Medium", and "Large", may be sequentially displayed, each for example, from one to two seconds. This sequence repeats until terminated by release of the key pad. The release of the key pad is to be done at the time of display of the desired size. For other foods, such as, for example, meats, the sequential or scanning display may be in the form of other parameters, such as, for example, "Rare", "Medium Rare", "Medium", and "Well Done".

Upon selection of the "Doneness" or "Size", the control system proceeds to control the oven to cook the food. During this cooking time, the alphanumeric display may give a display of the food being cooked, and the numeric display may provide a display of the remaining cooking time, and the power level.

Further prompts may be provided in the alphanumeric display for changes that must be made during the cooking time of a given food. For example, the program may halt the cooking at predetermined times, depending upon the foods to be cooked, to emit an audible alarm and display a prompt in the alphanumeric display, such as "Cover", "Turnover", and "Standing", indicating, for example that the user should cover the food at such time, turn the food at such time, or permit the food to stand in the oven for a given time.

In order that the invention will be more clearly understood it will now be disclosed in greater detail with reference to the accompanying drawings, wherein.

Figure 1:
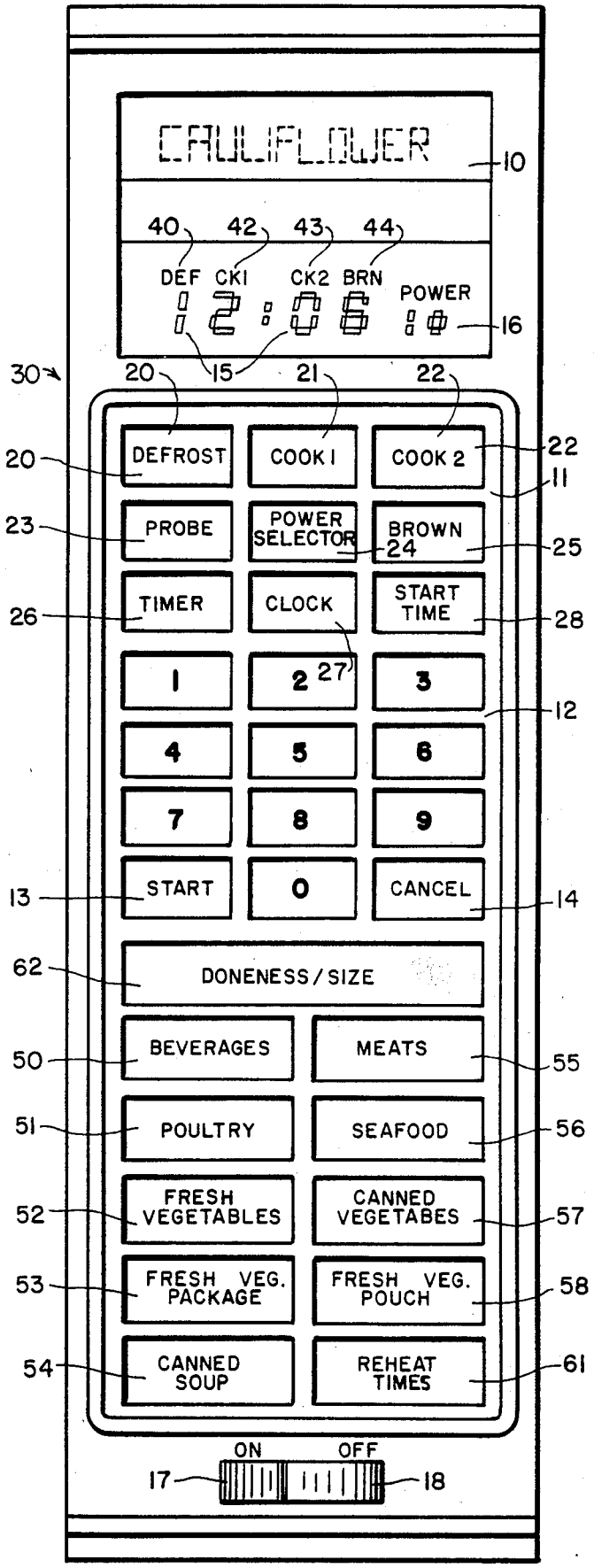
FIG. 1 is a front view of a display end control panel of a microwave oven, in accordance with one embodiment of the invention.

Referring now to the drawings, and more in particular to FIG. 1, therein is illustrated the front view of a preferred display control panel 30 for a microwave oven control system in accordance with the invention. The upper portion of the display and control panel 30 includes an alphanumeric display 10 of a plurality of characters, a plurality of function control pads 11, and numeric key pads 12. It is of course apparent that the pads may be of any type of manual data entry device, including keys.

The panel 30 may further include a start pad 13 to control the start of a cooking operation, a cancel pad 14 to enable the user to cancel any cooking instruction, and a numeric display including two pairs of digits 15 separated by a colon for displaying clock time and various other, and one or more digits 16 for displaying, for example, the power level.

The display and control panel 30 may further have "On" and "Off" switches 17 and 18, such as single latching type push button switches, for turning the microwave oven on and off. The selection of the above discussed displays and controls may of course be modified, without departing from the invention.

In the illustrated embodiment of the invention, the control pads 11 include a "Defrost" pad 10, a "Cook 1" pad 21, a "Cook 2" pad 22, a "Probe" pad 23, a "Power Selector" pad 24, a "Brown" pad 25, a "Timer" pad 26, a "Clock" pad 27, and a "Start Time" pad 28.

Figure 2:
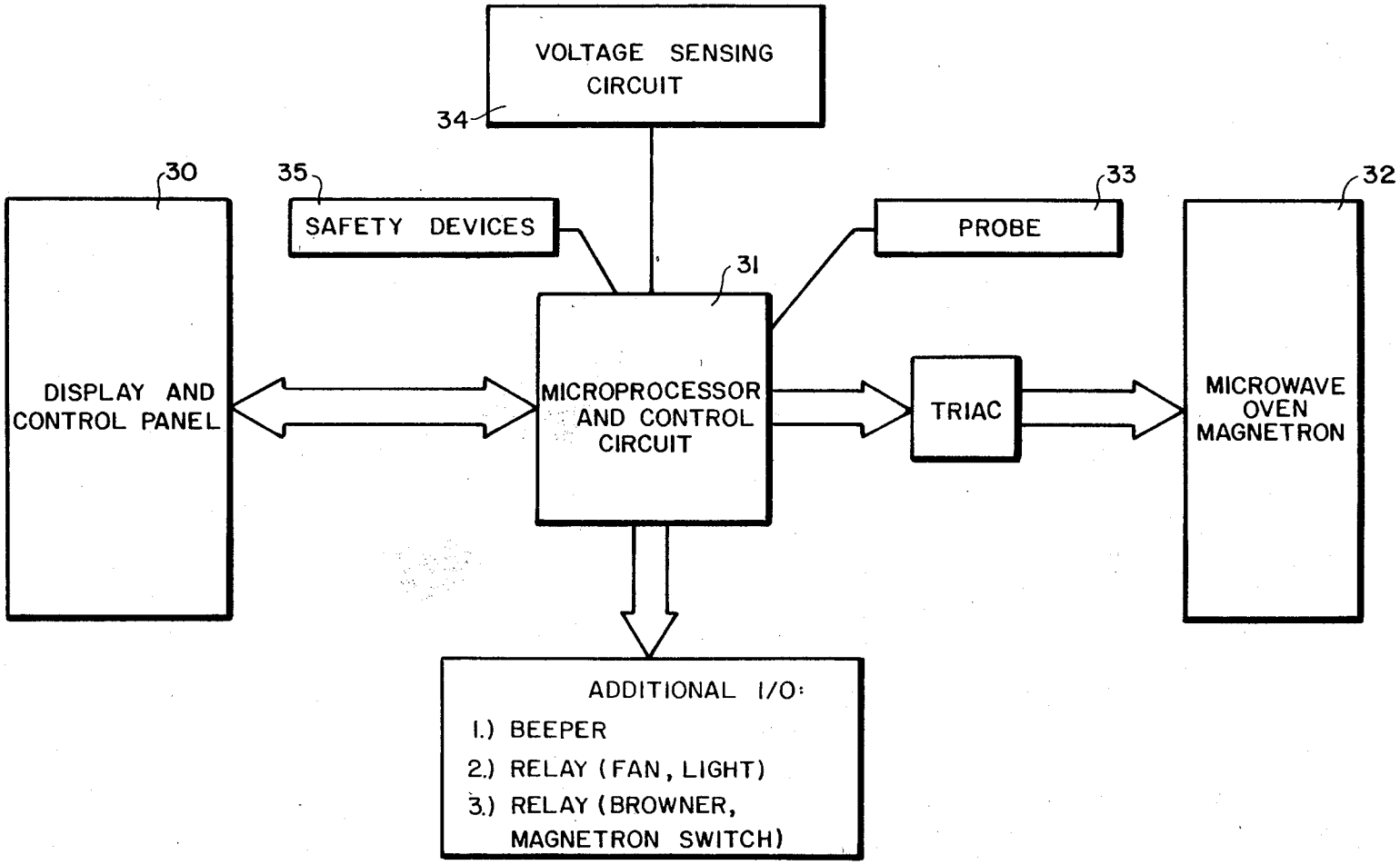
FIG. 2 is a simplified block diagram of the control system.

Before proceeding with the operation of the system in response to the above key pads, it is noted that, in the microwave oven system in accordance with the invention, as illustrated in FIG. 2, the display and control panel 30 of FIG. 1 is connected to a microprocessor and control circuit 31, the microprocessor and control circuit sensing the touching of pads on the display and control panel 30, and controlling the display of data on the display devices. The microprocessor and control circuit 31 is connected to control the application of power to the microwave oven magnetron 32. Further input devices are coupled to the microprocessor and control circuit 31, such as the probe 33 which is inserted in the food to be cooked, in order to enable use of the actual temperature of the food for controlling the magnetron. A voltage sensing circuit 34 is employed in order to enable control of the cooking time as a function of the input operating voltage, in the automatic cooking algorithm. Conventional safety devices 35 are also coupled to control the microprocessor and control circuit 31, for example ensuring that the magnetron is not energized when the door is open.

The microprocessor and control circuit 31 includes two microprocessors, for example a type NEC uPD 553 and a type NEC uPD 7508A, including programmed memory, so that the microprocessor and control circuit is responsive to the various inputs for controlling the display devices and the microwave oven magnetron. This circuit includes conventional energization circuits for the magnetron, under the control of the microprocessor. The various interconnections within the microprocessor and control circuitry are conventional.

The operation of the microwave oven in response to control of the pads 20–28 will now be discussed.

Upon depression of the "Defrost", "Cook 1", "Cook 2", or "Brown" pads, the program of the microprocessor controls the alphanumeric display 10 to display a prompt, for the user to enter a time. Upon touching the "On" pad, following the touching of one or more of the above control pads and entering time data, the microwave oven magnetron is controlled to effect the cooking operations "Defrost", "Cook 1", "Cook 2" and "Brown", in that order, independently of the order in which the controls were actuated.

In response to depression of the "Probe pad", the alphanumeric display 10 displays a prompt for the user to enter a temperature. Following the entry of any of the above control functions, the user may touch the "Power Selection" pad, followed by the selection, on the numerical pads, of a desired power level. If a choice is not made, the power level of operation of the oven for that function is automatically set to a power level of 10, with the exception of the "Defrost" function, in which case the power level is automatically set to a power level of 3. During a cooking sequence, the current function of operation of the oven is displayed on the alphanumeric display 10.

The display portion of the display control panel 30 may have a further series of display indicia "DEF" 40, "CK1" 42, "CK2" 43, and "BRN" 44, these display abbreviations being disposed, for example, above the time displays 15. In a cooking operation, when one or more of the cooking functions has been depressed, the displays 40–44 that correspond to cooking functions still to be effected, during the cooking cycle, would be energized. It is of course apparent that a cooking cycle may be comprised of one or more functions as above discussed. During the cooking cycle, the time remaining for the current cooking function is displayed on the display digits 15, and the current power level is displayed on the power level indicator 16.

The clock display may be set, for example, by depression of the "Clock" pad 27, followed by entry of the desired time and depression of the "Start" pad. A separate timer may be controlled by operation of the "Timer" pad 26 in conjunction with the entry of the desired time by the numerical pads, and operation of the "Start" pad.

Delayed operation of the cooking cycles may be effected by touching of the "Start Time" key pad 28, followed by the entry of the desired time of starting of the cooking operation on the numerical key pads 12. The subsequent entry of cooking instructions will hence be commenced, after touching of the "On" switch, at the entered starting time.

In a further feature of the invention, referring still to FIG. 1, the display and control panel 30 further includes a plurality of additional pads 50–58, 61 and 62. Of these pads, the pads 50–58 correspond to, and are provided with indicia denoting, separate food types, such as beverages, seafood, meat, etc. The pad 61 is labelled "Reheat Times", and the pad "62" is labelled "Doneness/-Size".

These additional pads 50–58, 61 and 62 enable control of the microwave oven to cook a plurality of selected foods that are most often cooked in microwave ovens. The pads enable the user to readily "Program" the microwave oven for such foods, without reference to any listings, by the use of slewed prompts on the alphanumeric display 10.

In the present disclosure, the terms slewing or scrolling of the display refer to the time sequential displaying of items of a related data group on the display, or, when applicable, the time sequential displaying of a group of numbers on the display.

In order to invoke this method of operation, the user initially touches one of the pads 50–58 corresponding to the type of food to be cooked (or the pad 61 if the food is to be reheated). Upon such operation of a pad, the program of the microprocessor controls the alphanumeric display 10 to slew a plurality of selected food items of the selected food type. Typical food items for which the microprocessor may be programmed, for the different food types, is illustrated in Table I.

| SELECTED FOOD TYPE | ITEM |
|---|---|
| BEVERAGES | WATER |
| BEVERAGES | COFFEE |
| BEVERAGES | MILK |
| SEAFOOD | FISH (FILLET) |
| SEAFOOD | FISH (WHOLE) |
| SEAFOOD | SHRIMP |
| MEATS | BACON |
| MEATS | FRANKS |
| MEATS | MEATLOAF |
| MEATS | BEEF ROAST |
| MEATS | PORK ROAST |
| MEATS | LAMB ROAST |
| POULTRY | CHICKEN |
| POULTRY | TURKEY |
| POULTRY | CORNISH HENS |
| CANNED SOUP | BROTH BASE |
| CANNED SOUP | CREAMY |
| CANNED SOUP | CHUNKY |
| CANNED VEG. | CORN |
| CANNED VEG. | GREEN BEANS |
| CANNED VEG. | PEAS |
| CANNED VEG. | BAKED BEANS |
| FRESH VEG. | BAKED POTATOES |
| FRESH VEG. | BROCCOLI |
| FRESH VEG. | CAULIFLOWER |
| FRESH VEG. | CARROTS |
| FRESH VEG. | ZUCCHINI |
| FRESH VEG. | CORN/COB |
| FROZEN VEG. - PACKAGE | CORN |
| FROZEN VEG. - PACKAGE | GREEN BEANS |
| FROZEN VEG. - PACKAGE | PEAS |
| FROZEN VEG. - PACKAGE | BROCCOLI |
| FROZEN VEG. - PACKAGE | MIXED VEG. |
| FROZEN VEG. - PACKAGE | LIMA BEANS |
| FROZEN VEG. - PACKAGE | CAULIFLOWER |
| FROZEN VEG. - PACKAGE | BRUSSEL SPROUTS |
| FROZEN VEG. - POUCH | CORN |
| FROZEN VEG. - POUCH | PEAS |
| FROZEN VEG. - POUCH | MIXED VEG. |
| FROZEN VEG. - POUCH | LIMA BEANS |

For example, assuming the user initially depressed the "Beverages" key pad 50, the microprocessor will control the alphanumeric display 10 to continuously sequentially display the food items "Water", "Coffee", and "Milk". The display of each item in the sequence may be, for example, from about 1 to 2 seconds, preferably 1.3 seconds. Such display time is sufficiently long to enable the user to respond by releasing the pad, and yet sufficiently short to minimize the time for scrolling the entire sequence of items. It is of course apparent that if the pad has not been released during the first sequential display of items on the list, the scrolling continues to repeat the list of items.

Upon release of the pad, i.e., the user removing his or her finger from the pad, the scrolling of the display immediately stops, with the last food item displayed being "Selected". The microprocessor stores this selection in temporary memory, i.e., RAM.

Following the release of the pad, the food item remains displayed on the alphanumeric display 10 for a determined time, for example, about 1 second, in order to ensure the user that the right choice had been selected. The microprocessor program then controls the alphanumeric display 10 to display a prompt relating to quantity of the food item to be cooked. For example, in the food type "Meats", had the food item "Bacon" been selected, a prompt "strips?" may be presented, whereupon the user may enter, for example, a number from 1 to 9 in the numerical key pads. The prompt for quantity of course depends upon the food item itself, and may, for example, be "Pounds?", "Cups?", "How Many?", etc.

For some food items, for example, milk or roast beef, the entry of a numerical quantity will not ensure the determination of the proper healing time, for example, as the result of variable initial temperatures, as well as variable container sizes. For such food items it is necessary to employ a temperature probe in the food itself. For such foods, then, the quantity prompt may be simply "Use Probe". If the microwave oven system senses the proper insertion of the temperature probe, for example, the connection of the probe in the oven, the "Use Probe" prompt may not appear, and the prompt is removed when the microwave oven system senses the interconnection of the probe in the oven.

Following the entry of the quantity data in the display and control panel 30, or, alternatively, the use of the probe, the microprocessor program controls the alphanumeric display to display a prompt relating to the doneness that is desired, or, depending upon the food, the size of the food item. For this purpose, the display initially displays a prompt "Doneness?" or "Size?", depending upon the selected food item. Upon depression of the "Doneness/Size" key pad 62, the alphanumeric display scrolls the possible choices, depending upon the selected food item. For example, had the food time "Bacon" been selected, the alphanumeric display scrolls the choices "Thin", "Regular", and "Thick", and continues such scrolling until the "Doneness/Size" key pad 62 is released.

Had the selected item been baked potatoes, the "Doneness/Size" prompts may be "Small", "Medium", and "Large" Had the food item been water or coffee, the "Doneness/Size" prompts may be "Warm", "Hot", and "Very Hot".

The REHEAT TIMES pad 61 does not follow the user input sequence of the pads 50–58. When the REHEAT TIMES pad is held down, display 10 shows REHEAT and display 15 shows one of six available reheat times and associated power levels is shown on display 16. As soon as the REHEAT TIME pad is released, operation begins with the timer counting down from the selected reheat time. Display 10 continues to show REHEAT, while display 15 shows the remaining time and display 16 shows the power level. The desired reheat time may be accessed by tapping the REHEAT TIMES pad an appropriate number of times, causing the reheat time displayed to sequentially step the times 0:10, 0:30, 1:00, 1:30, 2:00, and 3:00. The power level in all cases is 100% displaying 10. These times and power levels are default values and may be re-set, or programmed, by the user. The procedure for programming is:

(a) Put the ON/OFF switch in the OFF position.

(b) Hold the REHEAT TIMES pad 61 down (or tap it) until the time and power to be changed appear in Displays 15 and 16.

(c) Enter new time and power data with the key pads 12, and 24.

(d) Depress either the REHEAT TIMES pad or the START pad.

When the reheat times scroll through display 15 with the switch OFF, an 80 msec. audio signal is given whenever a new time and power appears. The signal is not given when the switch is ON. The intent of the signal is to clearly differentiate between the "program" and "use" modes.

When programming new reheat times, if the user does not enter a digit within 6 seconds after stopping at a given time and power level, the displays will revert to the normal system of priorities (displays 10 and 16 blank, clock in display 15).

After a given reheat time/power level has been set, holding down the REHEAT TIMES pad causes slewing to commence, starting with the next time in the list. If the REHEAT TIMES pad is held down when the end of the list is reached, rollover will occur, and the list will repeat.

Following these prompts and the insertion of the necessary data or the release of the related key pads, the temporary memory of the microprocessor system has stored therein data related to the food item, size and desired doneness as applicable. The program of the microprocessor then proceeds to determine the desired cooking time, in accordance with the algorithm:

$$T=(M\times Q\times(1+K\times D)+B)\times(V)$$

Where:

T is the cooking time in minutes.

Q is a variable dependent upon the entered or implied food quantity

M and B are linear equation parameters that are functions of the selected food item, these parameters being stored in tables in the microprocessor memory.

D is a parameter related to the spread between the low and high doneness/size levels, this parameter being dependent upon the given food item and being stored in a table in the memory of the microprocessor system.

K is a doneness/size integer, and may be minus 1, 0 or +1, depending upon the "Doneness/Size" quantity selected by the user.

V is a multiplication factor for correcting the cooking time for variations in the operating line voltage for the microwave oven. The multiplication factor V may, for example, vary from 2.0 to 0.88, for variations of the line voltage from 102 to 134 volts. Voltage sensing circuit 34 applies the quantity corresponding to the line voltage, to the microprocessor and control circuit 31.

The programs for the cooking of the various food items may also provide prompts on the alphanumeric display 10 at various periods during the cooking cycles. For example in the cooking of baked potatoes, a half way prompt of "Turnover" may be displayed. Following the removal of energization from the magnetron, a prompt may be given "Standing" for a determined duration, if the proper cooking procedure necessitates the food standing prior to use.

Some prompts and stored parameters that have been found satisfactory for several food items are presented in Table II.

TABLE II

| CATEGORY: FRESH VEGETABLES | ITEM: BAKED POTATOES |
|---|---|
| DISPLAY (ITEM SELECTION): BKD POTATO | |
| DISPLAY (WHILE COOKING): BKD POTATO | |
| QUANTITY PROMPT: HOW MANY? | |
| QUANTITY LIMITS: 1 to 9 STEP SIZE 1 | |
| DONENESS/SIZE: SMALL, MEDIUM, LARGE | |
| POWER LEVEL: 100% | |
| M = 2.6 | |
| B = 3.2 | |
| D = .35 | |
| BEGINNG PROMPT: NONE | |
| HALFWAY PROMPT: TURN OVER | |
| STANDING: STANDING (3 MIN. DURATION) | |
| CATEGORY: POULTRY | ITEM: CHICKEN |
| DISPLAY (ITEM SELECTION): CHICKEN | |
| DISPLAY (WHILE COOKING): CHICKEN | |
| QUANTITY PROMPT: POUNDS? | |
| QUANTITY LIMITS: .4 to 5 STEP SIZE .1 | |
| DONENESS/SIZE: WELL, VERY WELL, DRY | |
| POWER LEVEL: 100% | |
| M = 8.0 | |
| B = 0 | |
| D = .1 | |
| BEGINNING PROMPT: COVER | |
| HALFWAY PROMPT: TURN OVER | |
| STANDING: STANDING (10 MIN. DURATION) | |
| CATEGORY: MEATS | ITEM:BACON |
| DISPLAY (ITEM SELECTION): BACON | |
| DISPLAY (WHILE COOKING): BACON | |
| QUANTITY PROMPT: STRIPS? | |
| QUANTITY LIMITS: 1 to 9 STEP SIZE 1 | |
| DONENESS/SIZE: THIN, REGULAR, THICK | |
| POWER LEVEL: 100% | |
| M = .73 | |
| B = .92 | |
| D = .3 | |
| BEGINNING PROMPT: COVER | |
| HALFWAY PROMPT: NONE | |
| STANDING: NONE | |
| CATEGORY: FROZEN VEGETABLES (PACKAGE) | ITEM: PEAS |
| DISPLAY (ITEM) SELECTION): PEAS | |
| DISPLAY (WHILE COOKING): PEAS | |
| QUANTITY PROMPT: OUNCES? | |
| QUANTITY LIMITS: 5 to 20 STEP SIZE 1 | |
| DONENESS/SIZE: MEDIUM, MEDIUM HOT, HOT | |
| POWER LEVEL: 100% | |
| M = .37 | |
| B = 2.7 | |
| D = .2 | |
| BEGINNING PROMPT: COVER | |
| HALFWAY PROMPT: STIR | |
| STANDING: STANDING (3 MIN. DURATION) | |

Figure 3:
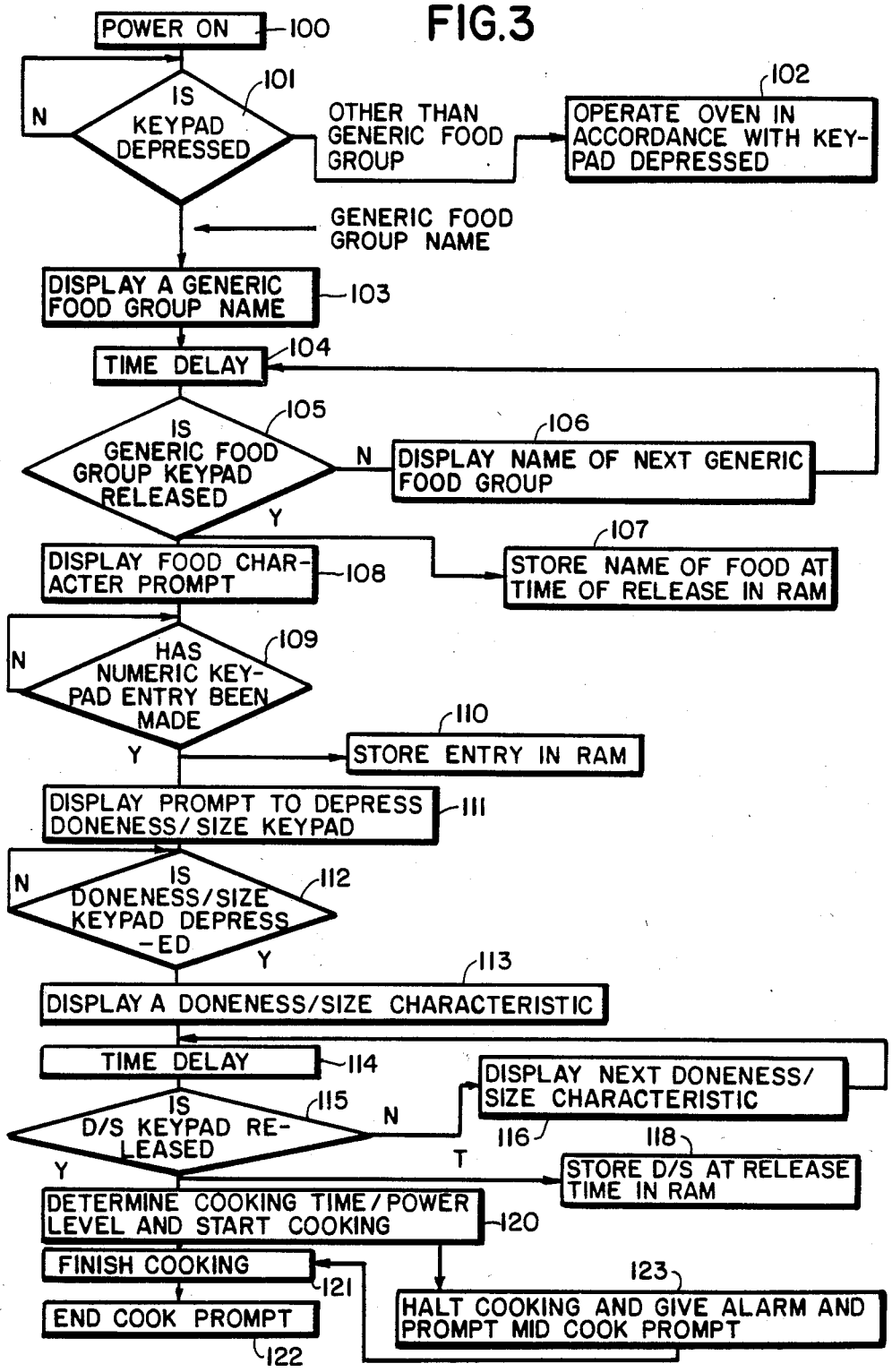
FIG. 3 is a simplified flow diagram showing the operation of the oven of the invention.

A simplified flow diagram showing the operation of the invention is illustrated in FIG. 3. When the power is switched on, block 100, the program tests the keyboard to determine if a key pad has been depressed, block 101, looping until the depression of a key pad has been sensed. If a key pad other than the generic food group key pads 50–61 has been depressed, the oven takes the necessary action in dependence upon the depressed key pad, for example, setting the timer or clock, or cooking under manual control, block 102. If, however, a generic food group key pad 50–61 has been depressed, the display 10 displays the first one of the foods of that group on display 10, block 103. After a time delay, block 104, the program tests whether or not the generic food group key pad has been released, block 105. If the key pad has not been released, indicating that the operator has not chosen the displayed food, the program displays the name of the next food in the corresponding food group, block 106, and loops back to the time delay 104 to hold that name in the display for a determinate time, followed by a further test in block 105 for the release of the key pad.

When the generic food group key pad has been released, the name of the food displayed at that time is stored in RAM, block 107, and the program then displays a food character prompt, block 108. For example, if the selected food is potatoes, the prompt may require a selection of the number of potatoes to be cooked. The key pad is then tested, block 109, for the depression of a proper key pad, and loops until a selection has been made. When a selection has been made, it is stored in RAM, block 110, and the program then displays a prompt for the operator to depress, the DONENESS/-SIZE key pad, block 111. The key pad is then sensed to determine if the DONENESS/SIZE key pad has been depressed, block 112, and loops until this key pad has been depressed.

When the DONENESS/SIZE key pad has been depressed, the program enables the display of a DONENESS/SIZE characteristic, block 113, for example, in the above case of potatoes, SMALL, MEDIUM or LARGE. The display is held for a time by time delay, block 114, and the key pad tested for release of the DONENESS/SIZE key pad, block 115. If this key pad is not released at the end of the time delay, the display is scanned to show the next DONENESS/SIZE characteristic, for example, MEDIUM, the program then looping back through the time delay via block 116 to again test the DONENESS/SIZE key pad release. If the DONENESS/SIZE key pad has been released, indicating that the operator has selected the currently displayed DONENESS/SIZE characteristic, this choice is stored in RAM, block 118, and the program proceeds to determine the correct cooking time and power level in accordance with the above relationship, and starts the cooking process, block 120.

Depending upon the food to be cooked, several different procedures may be followed. For example, if there are to be no intermediate prompts, the program proceeds to finish the cooking process, block 121, and give a prompt indicating that the cooking has ended, block 122. If, on the other hand, and intermediate step is required of the operator, the program halts the cooking at a determined time, gives an alarm, for example, an audible alarm indicating the stopping of cooking, and gives a prompt to the operator of a step that must taken, for example, turning over the food to be cooked, block 123. When this action has been taken, the program may proceed to block 121 to finish the cooking operation, and hence display the fact that cooking has ended.

It is of course apparent that the flow diagram of FIG. 3 is merely exemplary.

While the invention has been disclosed and described with reference to a single embodiment, it will be apparent that variations and modifications may be made therein, and it is therefore intended in the following claims to cover each such variation and modification which falls within the true spirit and scope of the invention.

What is claimed is:

1. In a cooking control system comprising an alphanumeric display, a keyboard having a plurality of data entry pads, and a programmed control system connected to said data entry pads and alphanumeric display for producing a timed control output for the operation of a microwave oven: the improvement wherein said data entry pads include a plurality of food entry pads each corresponding to a separate food type, said control means comprising means responsive to operation of said food entry pads for controlling said alphanumeric display to continually sequentially display the names of a plurality of different food items of the food type corresponding to the operated food entry pad, and to control the cessation of said sequential display in response to a further determined signal from said keyboard, said control means controlling the duration of said timed control output as a function of the food item displayed on said alphanumeric display at the time of said further determined signal.

2. The cooking control system of claim 1 wherein the name of each said food item of said plurality of food items is displayed for a period of 1 to 2 seconds during said continual sequential display.

3. The cooking control system of claim 1 wherein said control system comprises means for stopping said sequential display in response to release of the operated said food entry pad.

4. The cooking control system of claim 1 wherein said control means comprises means responsive to said cessation of said sequential display for displaying a prompt on said alphanumeric display for the quantity of food to be cooked.

5. The cooking control system of claim 4 wherein said control means further comprises means responsive to entry and said keyboard of a quantity, following the prompt quantity, for displaying on said alphanumeric display, a doneness/size prompt.

6. The cooking control system of claim 5 wherein said means for displaying said doneness/size prompt comprises means for sequentially displaying a plurality of doneness/size parameters on said alphanumeric display.

7. The cooking control system of claim 6 wherein said doneness/size prompt consists of sequentially displaying three different sequentially displayed items.

8. In a cooking control system comprising an alphanumeric display, a keyboard having a plurality of data entry pads, and a programmed control system connected to said data entry pads and alphanumeric display for producing a timed control output for the operation of a cooking control system: the improvement wherein said data entry pads include a plurality of food entry pads each corresponding to a separate food type, said control means comprising means responsive to operation of said food entry pads for controlling said alphanemeric display to continually sequentially display the names of a plurality of food items of the food type corresponding to the operated food entry pad, and to control the cessation of said sequential display in response to a further determined input from said keyboard, said control means further comprising means for receiving quantities from said data entry pads corresponding to the desired doneness or size, and quantity, of food items to be cooked, said control system further comprising means for providing an output control duration T, for energizing said cooking control system, of a duration:

$$T=(M\times Q\times(1+K\times D)+B)\times(V)$$

where M and B are linear equation constants dependent upon the selected food items, D is a constant that is a function of the selected food item determining the spread between the low and high doneness/size levels, K is a doneness/size integer which may be −1, 0 or +1, Q is a parameter dependent upon food quantity to be cooked, and V is a variable dependent upon the operating voltage of the cooking control system.

* * * * *